US009840830B2

(12) United States Patent
Lammli

(10) Patent No.: US 9,840,830 B2
(45) Date of Patent: Dec. 12, 2017

(54) REPLACEABLE WEAR STRIPS FOR GROUND ENGAGING EQUIPMENT

(71) Applicant: Ernest Lammli, Smoky Lake (CA)

(72) Inventor: Ernest Lammli, Smoky Lake (CA)

( * ) Notice: Subject to any disclaimer, the term of this patent is extended or adjusted under 35 U.S.C. 154(b) by 0 days.

(21) Appl. No.: 14/807,060

(22) Filed: Jul. 23, 2015

(65) Prior Publication Data

US 2016/0356025 A1 Dec. 8, 2016

(30) Foreign Application Priority Data

Jun. 8, 2015 (CA) ..... 2894038

(51) Int. Cl.
*E02F 9/28* (2006.01)
*E02F 3/815* (2006.01)
*E02F 3/40* (2006.01)

(52) U.S. Cl.
CPC ..... *E02F 9/2883* (2013.01); *E02F 3/8152* (2013.01); *E02F 3/40* (2013.01)

(58) Field of Classification Search
CPC ..... E02F 9/28; E02F 9/2883; E02F 9/2833; E02F 9/2841; E02F 3/60; E02F 3/8152; E02F 3/40
See application file for complete search history.

(56) References Cited

U.S. PATENT DOCUMENTS 3,912,325 A * 10/1975 Sudyk ..... B60R 13/01 105/423
4,128,132 A * 12/1978 Moen ..... E02F 9/28 172/747
4,459,768 A 7/1984 Albrecht
4,716,666 A 1/1988 Potter
5,063,695 A * 11/1991 Briscoe ..... E02F 9/28 172/753
5,129,168 A * 7/1992 Hedley ..... E02F 3/401 172/719
5,241,765 A * 9/1993 Jones ..... E02F 3/60 172/772
5,325,799 A * 7/1994 Rowlett ..... A01O 5/062 111/152

(Continued)

FOREIGN PATENT DOCUMENTS

CA 2633421 A1 6/2007
CN 204023639 U 12/2014

OTHER PUBLICATIONS

New Buckets, West-Trak Equipment Ltd. URL = http://www.west-trak.co.nz/new-buckets/, accessed on Apr. 13, 2015, 4 pages.

*Primary Examiner* — Jamie L McGowan
(74) *Attorney, Agent, or Firm* — Davis & Bujold PLLC; Michael J. Bujold

(57) ABSTRACT

A wear strip assembly has a wear strip and a wear strip support for use on ground engaging equipment. The wear strip has an engagement profile and a wear surface, and the wear strip support defines a receiving profile complementary to the engagement profile of the wear strip. The engagement profile of the wear strip removably engages the receiving profile of the wear strip support, and the wear strip support has one or more openings distributed along an inner edge of the wear strip support and below the receiving profile. The one or more openings have a thickness that permits the wear strip support to be welded to the ground engaging equipment.

10 Claims, 5 Drawing Sheets

(56) References Cited

U.S. PATENT DOCUMENTS

| | | | | |
|---|---|---|---|---|
| 6,041,529 | A | 3/2000 | Ruvang | |
| 6,194,080 | B1 * | 2/2001 | Stickling | E02F 9/2841 172/772 |
| 7,144,183 | B2 * | 12/2006 | Lian | E02F 9/2841 172/772 |
| 8,336,233 | B1 | 12/2012 | Lombardo et al. | |
| 8,561,326 | B2 * | 10/2013 | Ruvang | E02F 3/401 37/452 |
| 2009/0304442 | A1 | 12/2009 | Dennis et al. | |
| 2016/0069047 | A1 * | 3/2016 | Winter | E21C 1/00 37/444 |

* cited by examiner

REPLACEABLE WEAR STRIPS FOR GROUND ENGAGING EQUIPMENT

TECHNICAL FIELD

This relates to replaceable wear strips for attachment to the exterior surface of ground engaging equipment, such as excavating equipment, excavator buckets, etc.

BACKGROUND

During use, ground engaging equipment, such as excavating equipment, are subjected to abrasive and impact forces that can cause damage or wear to the structural material of the bucket. U.S. Pat. No. 8,336,233 teaches a wear plate assembly for attachment to the back of an excavator bucket to protect the outer surface from abrasion.

Referring to FIG. 1, a typical excavator bucket 100 is shown without any wear strips. In use, the exterior surface 102 of excavator bucket 100 comes into contact with rocks, soil, and other materials that may damage or cause wear to excavator bucket 100. In order to extend the life of excavator bucket 100, wear strips 104 may be added to exterior surface 102, as shown in FIG. 2. These wear strips 104 are typically attached in a permanent manner that is not intended to be removed, such as by welding strip 104 to excavator bucket 100.

SUMMARY

According to an aspect, there is provided a wear strip assembly for excavator equipment, the wear strip assembly comprising a wear strip having an engagement profile and a wear surface, and a wear strip support defining a receiving profile complementary to the engagement profile of the wear strip, such that the engagement profile of the wear strip removably engages the receiving profile of the wear strip support, the wear strip support having one or more openings distributed along an inner edge of the wear strip support and below the receiving profile, the one or more openings having a thickness that permits the wear strip support to be welded to the ground engaging equipment.

According to another aspect, the wear strip support may comprise first and second portions that may be spaced to define a desired width of the receiving profile.

According to another aspect, the one or more openings may be defined between the first and second portions.

According to another aspect, the wear strip support may comprise a unitary body and the openings may be formed in a bottom surface of the wear strip support.

According to another aspect, the wear strip may be held in relative position to the wear strip support exclusively by a weld at one or both ends of the weld strip.

According to an aspect, there is provided an excavator bucket having a plurality of wear strip assemblies, the excavator bucket comprising an interior and an exterior, the wear strip assemblies comprising a wear strip having an engagement profile and a wear surface, and a wear strip support defining a receiving profile complementary to the engagement profile of the wear strip, such that the engagement profile of the wear strip removably engages the receiving profile of the wear strip support, the wear strip support having one or more openings distributed along an inner edge of the wear strip support, and below the receiving profile, the one or more openings having a thickness that permits the wear strip support to be welded to the exterior of the excavator bucket.

According to another aspect, the wear strip support may comprise first and second portions that may be spaced to define a desired width of the receiving profile.

According to another aspect, the one or more openings may be defined between the first and second portions.

According to another aspect, the wear strip support may comprise a unitary body and the openings may be formed in a bottom surface of the wear strip support.

According to another aspect, the wear strip may be held in relative position to the wear strip support exclusively by a weld at one or both ends of the weld strip.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
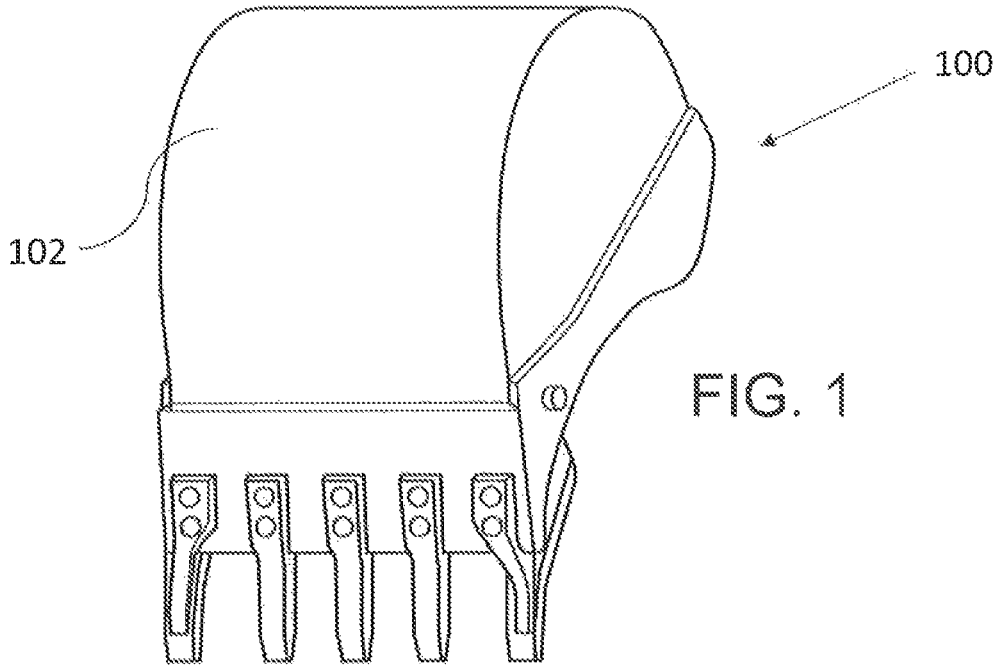
FIG. 1 is a perspective view of an excavator bucket prior to installation of wear strips.
Figure 2:
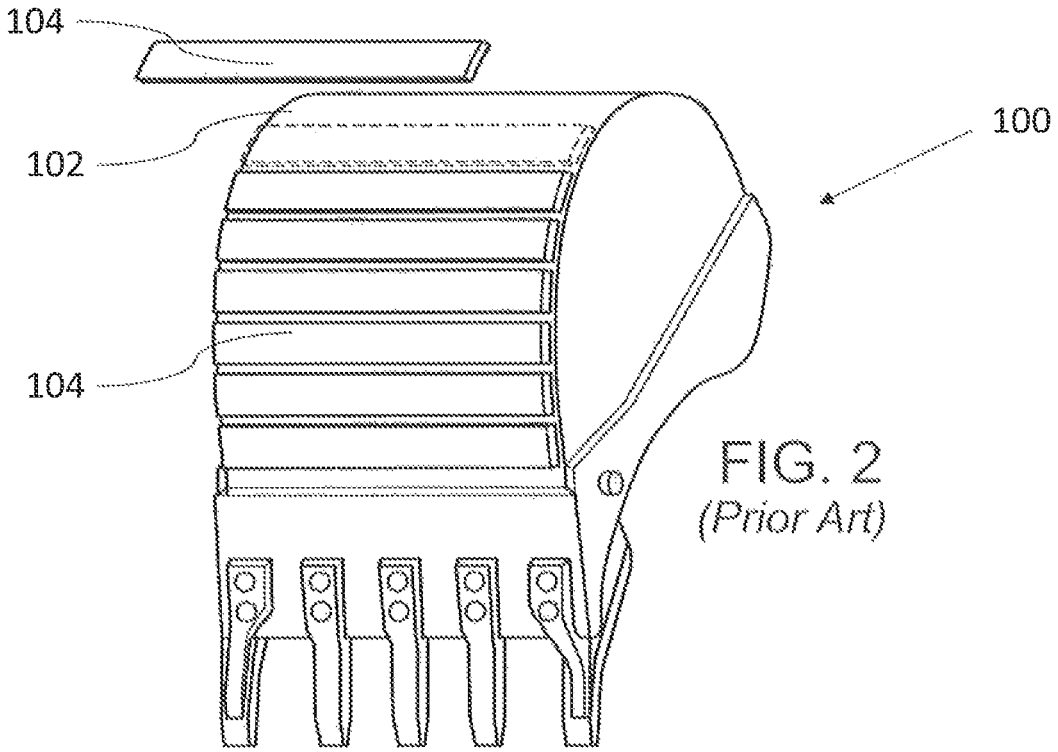
FIG. 2 (Prior Art)
FIG. 2 is a perspective view of an excavator bucket showing prior art wear strips welded directly to the bucket.

A wear strip assembly, generally identified by reference numeral 10, will now be described with reference to FIG. 1 through 8. While the embodiments described herein relate to excavator buckets, it will be understood that wear strip assembly 10 may be used on any ground engaging equipment, such as equipment used in excavating or earth-moving operations, and may be attached to any suitable part of the equipment that it may be desired to protect from wear. This includes static components as well as moving components, as well as those components that are actively engaging the material being excavated and those that provide support or control but do not directly engage the material being excavated.

Figure 4:
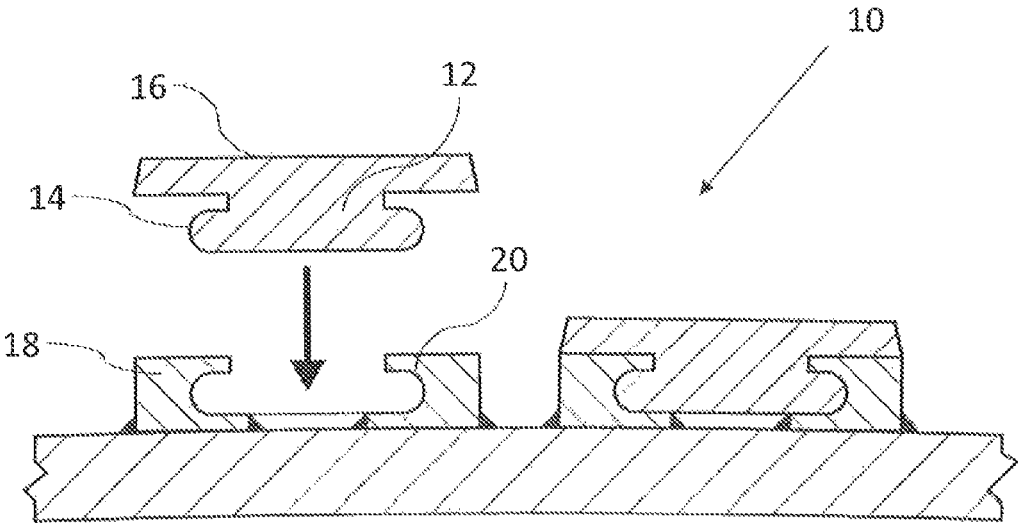
FIG. 4 is a detailed side elevation view in section of an engagement profile of the wear strip assemblies shown in FIG. 3.
Figure 5:
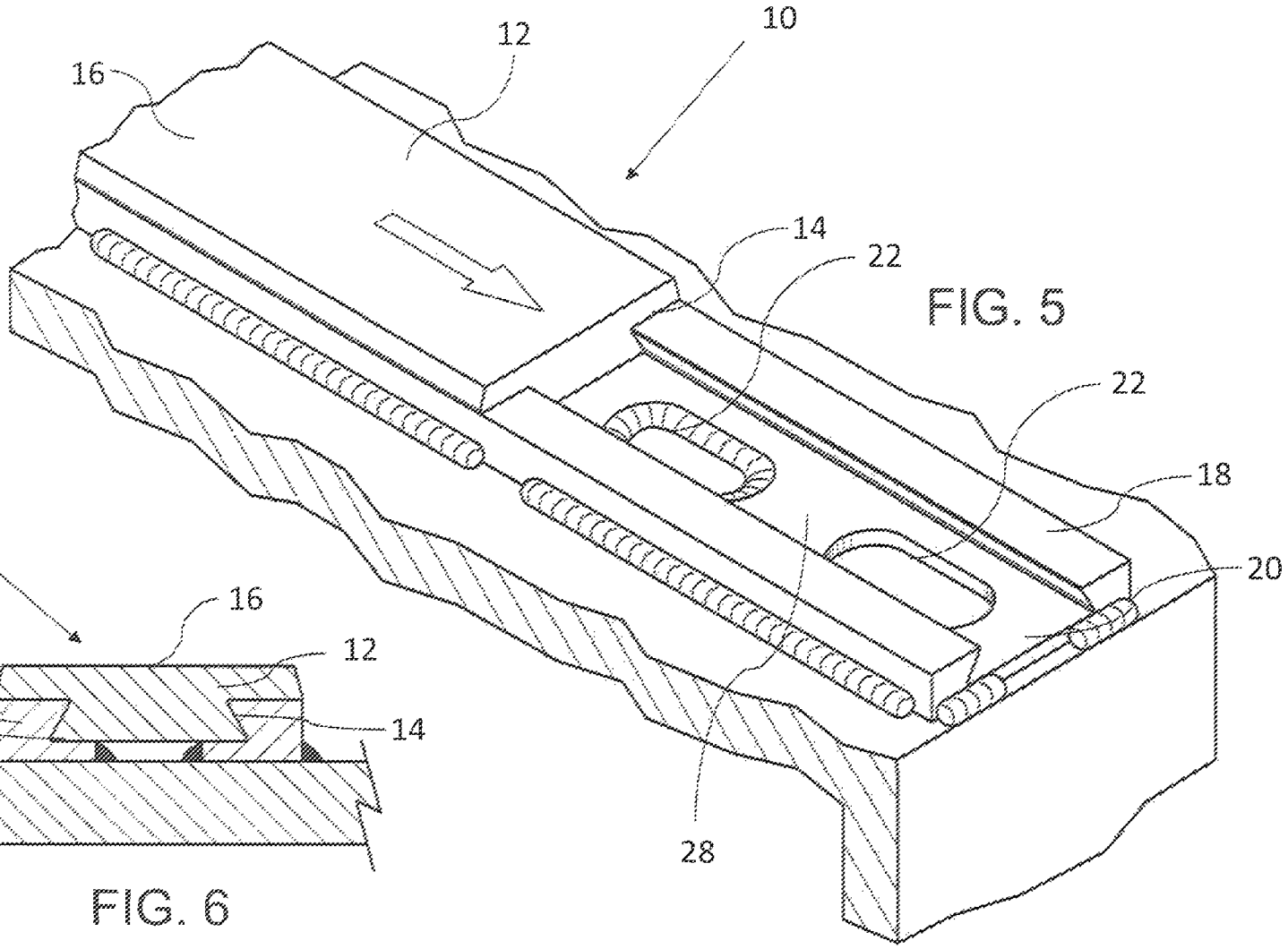
FIG. 5 is a detailed perspective view of an alternate engagement profile of the wear strip assemblies shown in FIG. 3.
Figure 6:
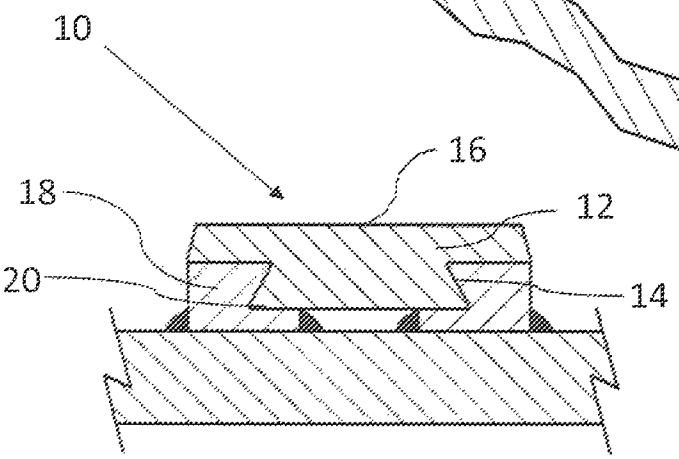
FIG. 6 is a detailed side elevation view in section of the engagement profile shown in FIG. 5.

Referring to FIG. 5, wear strip assembly 10 has a wear strip 12 having an engagement profile 14 and a wear surface 16. Engagement profile 14 may take a variety of forms, such as a rounded tab profile shown in FIG. 4, or an angular profile as shown in FIG. 6. Wear strip assembly 10 also has a wear strip support 18 defining a receiving profile 20 that is complementary to engagement profile 14 of wear strip 12, as shown in FIG. 4 and FIG. 6. Referring to FIG. 5, engagement profile 14 removably engages receiving profile 20, such that wear strip 12 can be removably attached to wear strip support 18. As shown in FIG. 5, the complementary profiles allow wear strip 12 to slide into wear strip support 18, and the shape of the profiles prevents wear strip 12 from being removed perpendicular to the surface. Preferably, weld strip 12 and wear strip support 18 are single, extruded bodies along their length as this increases the strength and simplifies installation. It will be understood that it may be possible to provide various lengths of weld strips 12 and wear strip supports 18, such that there would be more than one piece installed on the exterior surface of the ground engaging equipment. However, longer pieces are preferred, such as no more than 1 or 2 pieces for a length of weld strip 12 and wear strip support 18. In addition, as wear strip 12 slides into receiving profile 20, it will also be understood that wear strip assembly 10 is ideally used on flat sections of surfaces, or along a flat line on a surface, such as transversely on an excavator bucket as shown in the drawings. It may be possible to install wear strip supports 18 on a curved surface, however the curve must have a constant radius of curvature, and there must be sufficient access on either side of wear strip support 18 to allow a curved wear strip 12 to be inserted or removed.

Figure 8:
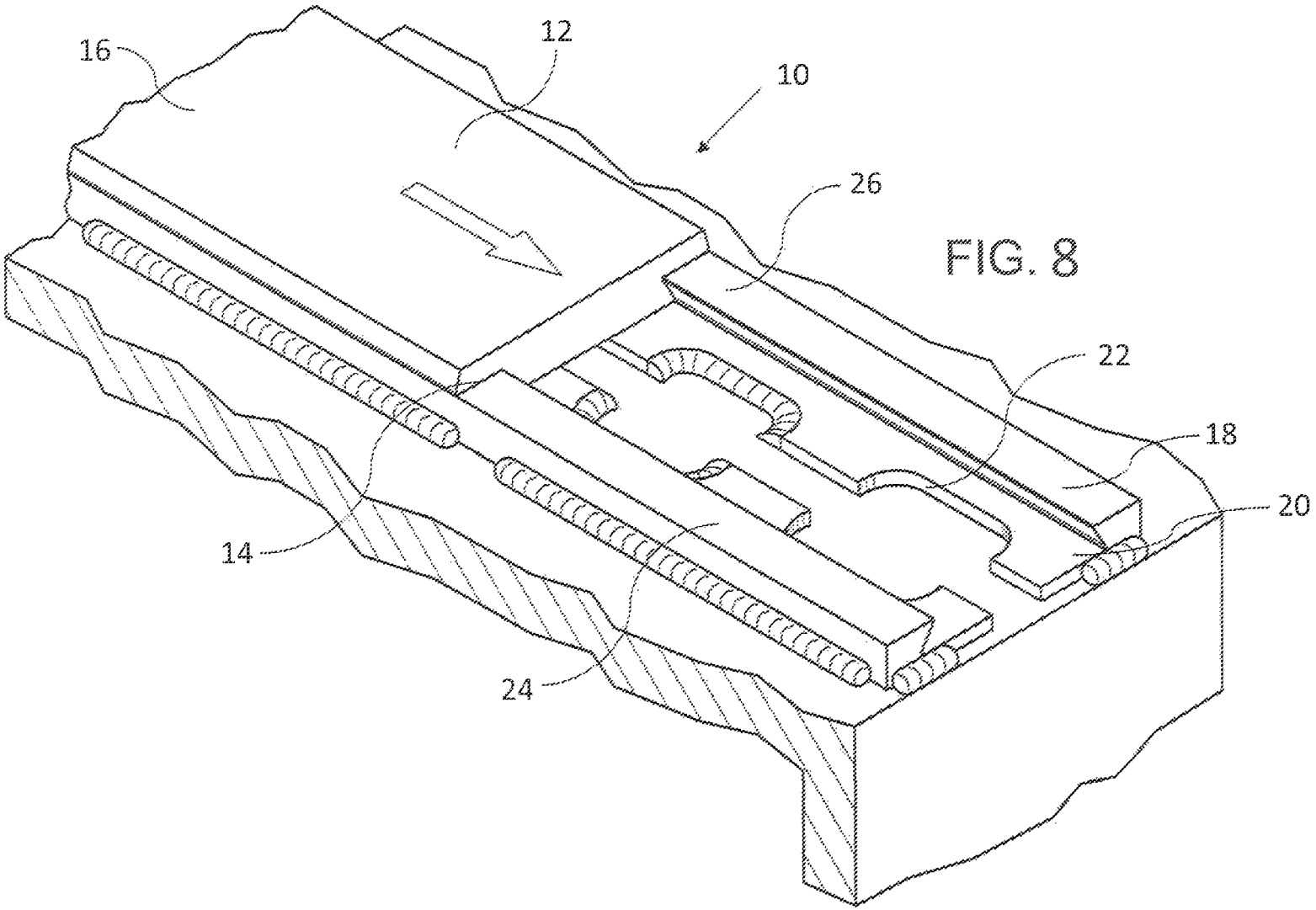
FIG. 8 is a detailed perspective view of a wear strip assembly with an engagement profile that has an adjustable width.

Wear strip support 18 has one or more openings 22 distributed along an inner edge of wear strip support 18 and below receiving profile 20. As shown in FIG. 8, wear strip support 18 may be made from first portion 24 and second portion 26 that can be spaced to define a desired width of receiving profile 20. In the case of wear strip support 18 having two portions 24 and 26, the one or more openings 22 are defined between first and second portions 24 and 26, as shown. Alternatively, as shown in FIG. 5, wear strip support 18 may be a unitary body and in this case openings 22 are formed in a bottom surface 28 of wear strip support 18. The one or more openings 22 have a thickness that permits wear strip support 18 to be welded to excavator bucket 100 without the weld material interfering with the movement of wear strips 12 through wear strip support 18. In order to prevent lateral movement of wear strip 12 relative to wear strip support 18, wear strip 12 may be held in relative position to wear strip support 18 by a weld 30 at one or both ends of wear strip 12. Weld strip 12 may be welded at both ends or only at one end, depending on the preferences of the user. If weld strip 12 is not a single piece as shown in the depicted embodiments and as is be preferred, it will be necessary to apply welds at either end. The weld may be for example, a tack weld that may easily be removed. It will be understood that weld 30 is not intended to be strong enough to fully install wear strip 12; rather it is merely intended to be used to hold wear strip 12 against lateral movement out from wear strip support 18, while allowing wear strip 12 to be easily removed. Other approaches to holding wear strip 12 will be apparent to those skilled in the art.

The width of wear strip support 18 is preferably narrow enough to allow them to be installed on a curved surface of excavator bucket 100 without difficulty. This will depend on the curvature of bucket 100 and the tolerances implemented during construction.

Figure 3:
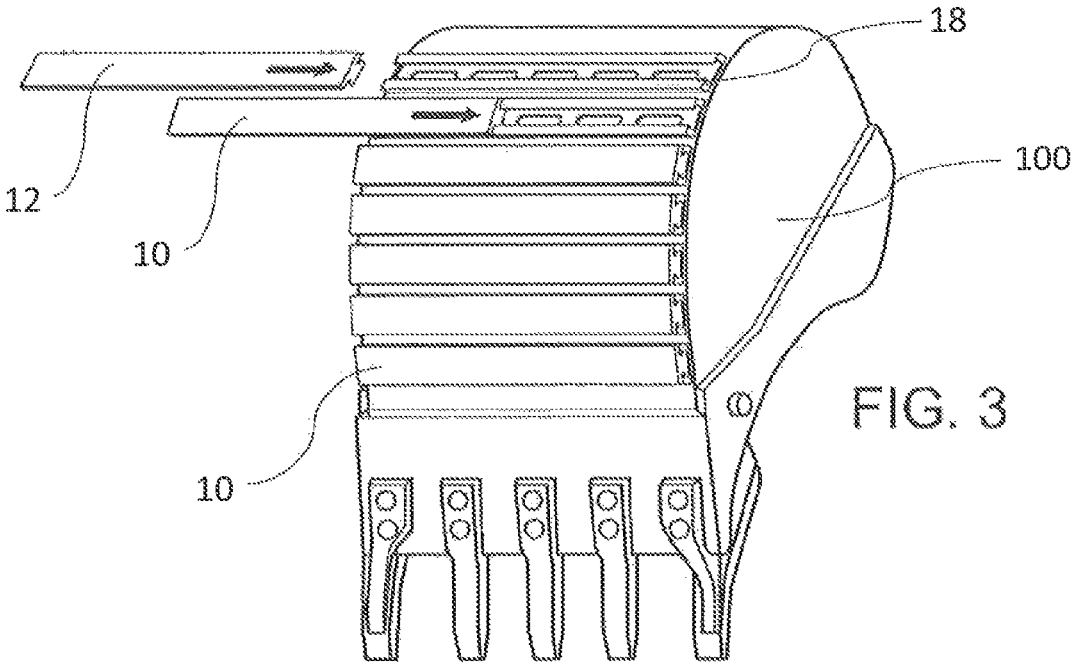
FIG. 3 is a perspective view of an excavator bucket with wear strip assemblies installed on an outer surface.

Referring to FIG. 3, excavator bucket 100 is shown with removable wear strip assemblies 10 being installed by first attaching wear strip supports 18 to excavator bucket 100. Referring to FIG. 5, when wear strip support 18 is a unitary body, wear strip support 18 is welded around its perimeter, as well as in openings 22, to properly anchor wear strip supports 18 to excavator bucket 100. Referring to FIG. 8, wear strip support 18 may also be funned from two portions 24 and 26, such that wear strip support 18 is installed by welding around the perimeter of each portion 24 and 28, including in openings 22. Wear strip support may be made from two portions 24 and 26, such as to accommodate a variety of possible widths of wear strips 12 without having to provide multiple sizes of wear strip supports 18. If using two portions 21 and 26, portion 24 may be installed first, and the width of wear strip 12 may be used to set the position of second portion 26. Both wear strips 12 and wear strip supports 18 may be extruded, molded or formed using other known techniques.

Figure 7:
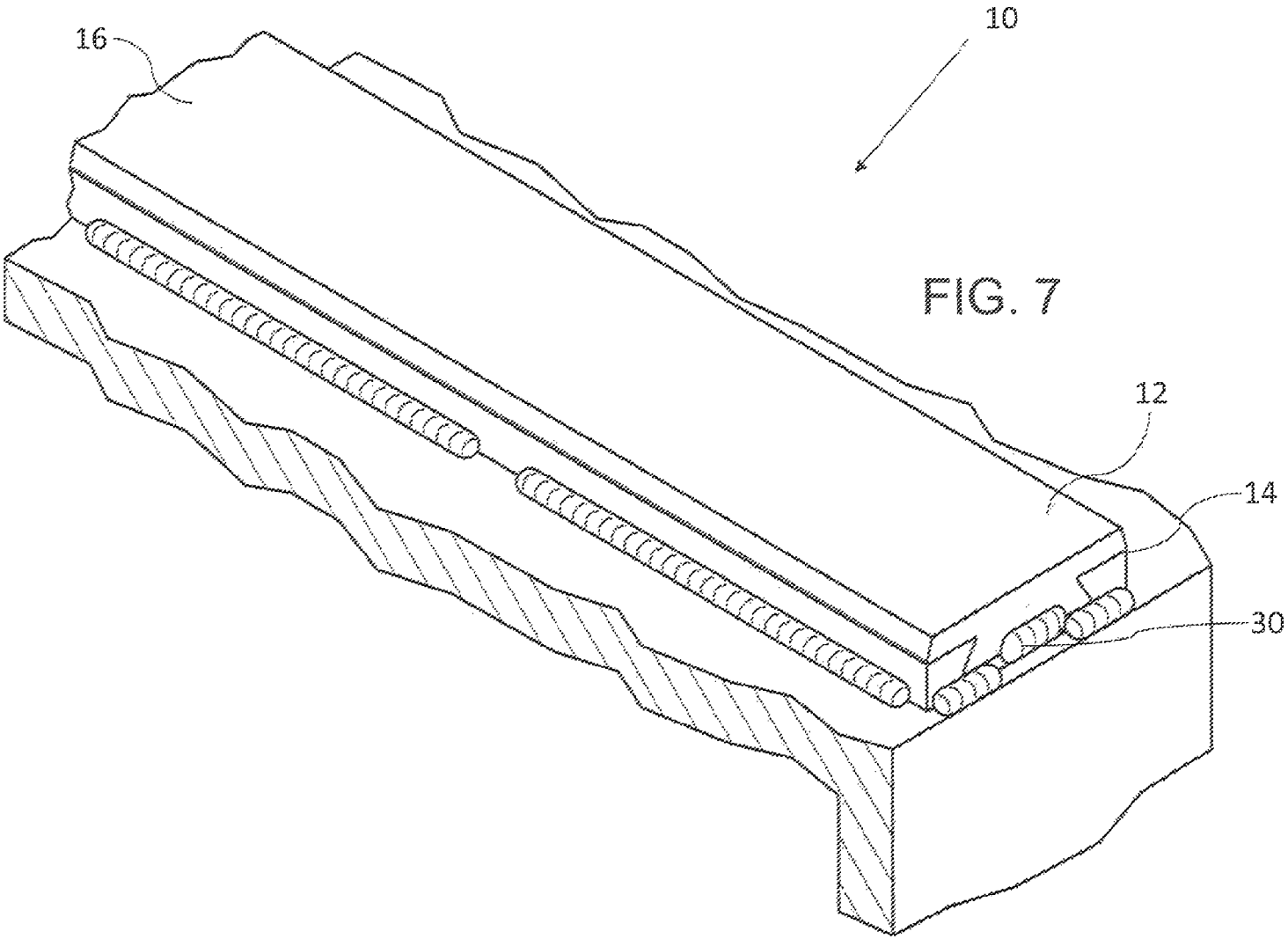
FIG. 7 is a detailed perspective view of a wear strip assembly that has been tack welded in place.

Referring again to FIG. 3, once wear strip supports 18 have been installed on excavator bucket 100, wear strips 12 are slid into wear strip supports 18 using engagement profile 14 and receiving profile 20. Referring to FIG. 7, wear strips 12 may then be secured against lateral movement of wear strip 12 relative to wear strip support 18, such as by applying a weld 30. Weld 30 is preferably applied sparingly such that it is easy to remove when desired to do so. When wear strip 12 becomes damaged or worn, it is released to allow lateral movement, such as by removing weld 30, and wear strip 12 is then slid out of wear strip support 18. A new wear strip 12 can then be slid into place and re-welded.

By providing removable and replaceable wear strips, it becomes possible to continually replace wear strips and protect bucket 100 against unnecessary wear. If wear strips 12 were installed directly on excavator bucket 100 as is commonly done, it becomes difficult to remove and replace wear strips 12 without damaging excavator bucket 100. In addition, wear strips 12 may be made from a different material with beneficial properties for wear strips that may otherwise be difficult to secure by welding or otherwise install on bucket 100.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A wear strip assembly for ground engaging equipment, the wear strip assembly comprising:

a wear strip having an engagement profile and a wear surface, the engagement profile extending an entire length of the wear strip and having a constant cross-sectional area along the entire length of the wear strip; and a wear strip support defining a receiving profile complementary to the engagement profile of the wear strip, the receiving profile extending an entire length of the wear strip support, the receiving profile having a constant cross-sectional area along the entire length of the wear strip support, the engagement profile of the wear strip removably engaging the receiving profile of the wear strip support such that the wear surface faces away from the ground engaging equipment, the wear strip support having one or more openings distributed along an inner edge of the wear strip support and below the receiving profile, the one or more openings having a thickness that permits the wear strip support to be welded to the ground engaging equipment.

2. The wear strip assembly of claim 1, wherein the wear strip support comprises first and second portions that are spaced to define a desired width of the receiving profile.

3. The wear strip assembly of claim 2, wherein the one or more openings are defined between the first and second portions.

4. The wear strip assembly of claim 1, wherein the wear strip support comprises a unitary body and the openings are formed in a bottom surface of the wear strip support.

5. The wear strip assembly of claim 1, wherein the wear strip is held in relative position to the wear strip support exclusively by a weld at one or both ends of the weld strip.

6. An excavator bucket having a plurality of wear strip assemblies, the excavator bucket comprising an interior surface and an exterior surface, each wear strip assembly comprising:

a wear strip having an engagement profile and a wear surface, the engagement profile extending an entire length of the wear strip and having a constant cross-sectional area along the entire length of the wear strip; and a wear strip support defining a receiving profile complementary to the engagement profile of the wear strip, the wear strip support extending from a first side of the excavator bucket to a second side of the excavator bucket that is opposite the first side, the receiving profile extending an entire length of the wear strip support, the receiving profile having a constant cross-sectional area along the entire length of the wear strip support, the engagement profile of the wear strip removably engaging the receiving profile of the wear strip support such that the wear surface faces away from the exterior surface of the excavator bucket, the wear strip support having one or more openings distributed along an inner edge of the wear strip support and below the receiving profile, the one or more openings having a thickness that permits the wear strip support to be welded to the exterior surface of the excavator bucket.

7. The excavator bucket of claim 6, wherein the wear strip support comprises first and second portions that are spaced to define a desired width of the receiving profile.

8. The excavator bucket of claim 7, wherein the one or more openings are defined between the first and second portions.

9. The excavator bucket of claim 6, wherein the wear strip support comprises a unitary body and the openings are formed in a bottom surface of the wear strip support.

10. The excavator bucket of claim 6, wherein the wear strip is held in relative position to the wear strip support exclusively by a weld at one or both ends of the weld strip.

* * * * *